US009512533B2

(12) United States Patent
Su et al.

(10) Patent No.: US 9,512,533 B2
(45) Date of Patent: Dec. 6, 2016

(54) ELECTROPLATING EQUIPMENT CAPABLE OF GOLD-PLATING ON A THROUGH HOLE OF A WORKPIECE

(71) Applicant: MIN AIK PRECISION INDUSTRIAL CO., LTD., Taoyuan (TW)

(72) Inventors: Yu-Cheng Su, New Taipei (TW); Chun-Yang Chang, Taoyuan (TW)

(73) Assignee: MIN AIK PRECISION INDUSTRIAL CO., LTD., Taoyuan (TW)

( * ) Notice: Subject to any disclaimer, the term of this patent is extended or adjusted under 35 U.S.C. 154(b) by 90 days.

(21) Appl. No.: 14/715,608

(22) Filed: May 19, 2015

(65) Prior Publication Data

US 2016/0032476 A1 Feb. 4, 2016

(30) Foreign Application Priority Data

Jul. 29, 2014 (TW) ..... 103213426 A

(51) Int. Cl.

| | |
|---|---|
| ***C25D 5/02*** | (2006.01) |
| ***C25D 17/00*** | (2006.01) |
| ***C25D 7/04*** | (2006.01) |
| ***C25D 3/48*** | (2006.01) |
| *C25D 3/12* | (2006.01) |

(52) U.S. Cl.

CPC ..... *C25D 5/022* (2013.01); *C25D 3/48* (2013.01); *C25D 7/04* (2013.01); *C25D 17/00* (2013.01); *C25D 3/12* (2013.01); *C25D 17/004* (2013.01)

(58) Field of Classification Search

CPC ..... C25D 5/02; C25D 5/022

USPC ..... 205/131, 133; 427/97.2, 97.7

See application file for complete search history.

(56) References Cited

U.S. PATENT DOCUMENTS

| | | | | | |
|---|---|---|---|---|---|
| 1,403,903 | A * | 1/1922 | Hamister | C25D 5/08 | 205/131 |
| 2,706,175 | A * | 4/1955 | Licharz | C25D 5/08 | 204/272 |
| 3,376,210 | A * | 4/1968 | Buske | C25D 7/10 | 204/287 |
| 3,483,097 | A * | 12/1969 | Greb | C25D 7/04 | 204/479 |
| 3,645,881 | A * | 2/1972 | Williams | C25D 7/04 | 204/288.1 |
| 3,798,136 | A * | 3/1974 | Olsen | C25D 7/04 | 205/118 |
| 3,891,515 | A * | 6/1975 | Paulson | C25D 5/44 | 204/DIG. 7 |

(Continued)

FOREIGN PATENT DOCUMENTS

| | | | | |
|---|---|---|---|---|
| JP | 10-176297 A * | 6/1998 | ..... | C25D 5/02 |

*Primary Examiner* — Harry D Wilkins, III

(74) *Attorney, Agent, or Firm* — Winston Hsu; Scott Margo

(57) ABSTRACT

The electroplating equipment disposes a hollow first ring between a first mold and a through hole of a workpiece, and a hollow second ring between a second mold and the through hole of the workpiece, such that the first ring and the second ring provide substantially equivalent channel as the openings of the through hole when the first mold and the second mold are set to hold tight the workpiece. The first ring and the second ring, along with an injection channel of the first mold and a recycling channel of the second mold and the through hole of the workpiece, form a seamless flow channel for an electroplating fluid to flow and be electroplated on the wall of the through hole.

6 Claims, 5 Drawing Sheets

(56) References Cited

U.S. PATENT DOCUMENTS

| | | | | | |
|---|---|---|---|---|---|
| 4,294,670 | A * | 10/1981 | Raymond | C25D 17/10 | 205/131 |
| 4,441,966 | A * | 4/1984 | Onda | C25D 5/08 | 204/224 R |
| 5,431,802 | A * | 7/1995 | Sukimoto | F16J 10/04 | 205/131 |
| 5,496,463 | A * | 3/1996 | Mori | C25D 15/02 | 204/275.1 |
| 5,540,829 | A * | 7/1996 | Mase | C25D 15/02 | 205/109 |
| 8,815,062 | B2 * | 8/2014 | Asou | C25D 7/00 | 204/227 |
| 2003/0000830 | A1 * | 1/2003 | Spain | C25D 5/02 | 204/194 |
| 2005/0167276 | A1 * | 8/2005 | Stilli | B22D 11/059 | 205/103 |
| 2012/0080318 | A1 * | 4/2012 | Gillen | C25D 5/02 | 205/131 |
| 2014/0023876 | A1 * | 1/2014 | Nagata | C25D 3/48 | 428/596 |

* cited by examiner

ELECTROPLATING EQUIPMENT CAPABLE OF GOLD-PLATING ON A THROUGH HOLE OF A WORKPIECE

BACKGROUND OF THE INVENTION

1. Field of the Invention

The invention relates to an electroplating equipment, and more particularly, to an electroplating equipment capable of gold-plating on a through hole of a workpiece.

2. Description of the Prior Art

Conventionally, as one metal component is to be assembled with another metal component via tinplating, electro nickelling should be carried out at the spot first. As for the tiny through hole of the metal component to be tinplated, nickel is electroplated on the whole surface, including the wall of the through hole, to simplify the electroplating process. Nickel plating, however, is not much a best material for attachment and fitness of the tinplating and gold-plating is considered by modern technology as a best substitute for nickel-plating that provides better attachment and fitness for tinplating.

Since gold is much expensive than nickel, it is more required to electroplating just the processing spot with gold than with nickel to save unnecessary cost. Once the whole surface of the metal component is electroplated with gold, the through hole should be sealed with plastic piece like a silicone post before removing the plating of other unsealed area, so that a metal workpiece that only the through hole is electroplated with gold can be obtained. However, such procedure takes a lot of human works to do the plug in the through hole with plastic piece. Secondly, electroplating the whole area followed by removing and collecting those on the nonfunctional area just add one more procedure.

SUMMARY OF THE INVENTION

To solve the above mentioned problem, an electroplating equipment capable of gold-plating on a through hole of a workpiece that can simplify the procedure is provided in the invention.

According to an embodiment of the invention, an electroplating equipment capable of gold-plating on a through hole of a workpiece is provided. The through hole includes a first opening and a second opening at opposite sides of the workpiece. A wall of the through hole is formed between the first opening and the second opening. The electroplating equipment includes a first mold, a second mold, a first ring, and a second ring. The first mold is electrically coupled to an electroplating positive electrode. The first mold is disposed at one side of the workpiece facing the first opening. The first mold includes an injection channel aligning with the first opening. The second mold is electrically coupled to an electroplating negative electrode. The second mold is disposed at the other side of the workpiece facing the second opening. The second mold includes a recycling channel aligning with the second opening. The first ring includes a first hollow hole and is disposed between the injection channel of the first mold and the first opening. The second ring includes a second hollow hole and is disposed between the recycling channel of the second mold and the second opening. The first mold and the second mold holds tight the workpiece by exerting pressing force on the workpiece and an electroplating fluid from the injection channel flows through the first opening and is electroplated onto the wall when flowing through the wall, and the electroplating fluid is recycled from the recycling channel after flowing through the second opening.

According to the embodiment of the invention, when the first mold and the second mold holds tight the workpiece by exerting pressing force on the workpiece, the first ring and the second ring are pressed to deform and the contour of the first hollow hole is no less than the first opening and the contour of the second hollow hole is no less than the second opening.

According to the embodiment of the invention, the contour of the first hollow hole is substantially the same as and slightly larger than the first opening and the contour of the second hollow hole is substantially the same as and slightly larger than the second opening.

According to the embodiment of the invention, the first mold and the first ring are disposed gravitationally under the workpiece and the second mold and the second ring are disposed gravitationally over the workpiece.

According to the embodiment of the invention, the injection channel, a hole wall defining the first hollow hole of the first ring, a hole wall defining the second hollow hole of the second ring, and the recycling channel cooperatively form a seamless flow channel with the wall of the through hole.

According to the embodiment of the invention, the first ring and the second ring are made of silicone.

The electroplating equipment provided in the application is particularly suitable for electroplating the workpiece with miniature through hole and the process of peeling and recycling electroplating metal on other nonfunctional area is no longer required.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. In the following discussion and in the claims, the terms "include" and "comprise" are used in an open-ended fashion. Also, the term "couple" is intended to mean either an indirect or direct electrical connection. Thus, if a first device is coupled to a second device, that connection may be through a direct electrical connection, or through an indirect electrical connection via other devices and connections.

Figure 1:
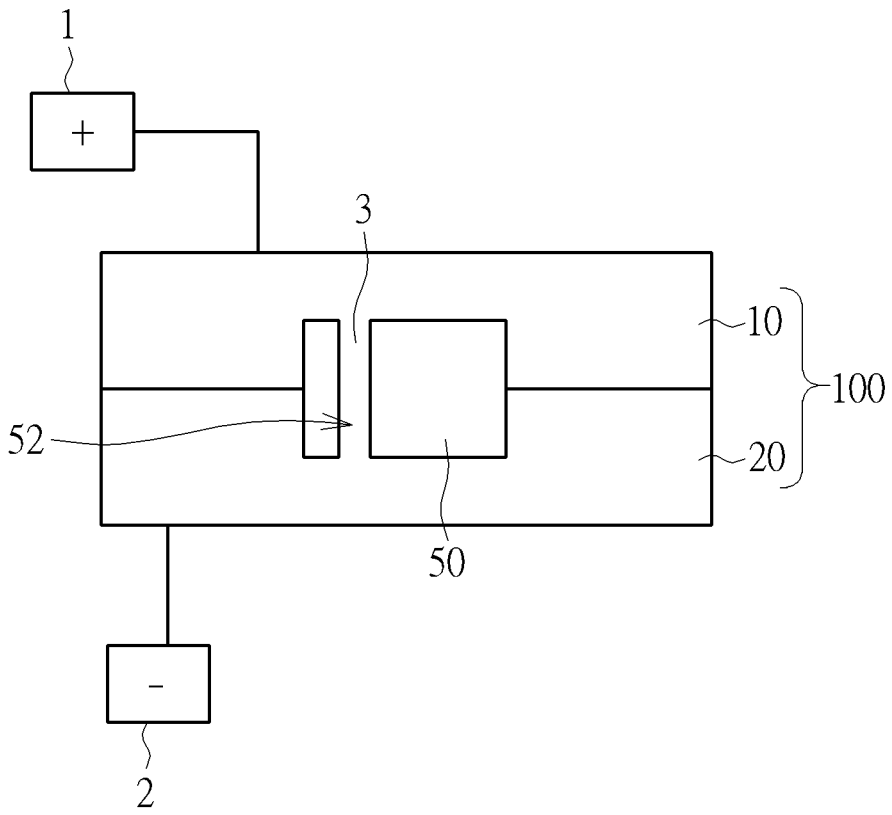
FIG. 1 is a schematic diagram showing the concept of an electroplating equipment and a workpiece according to the invention.

Please refer to FIG. 1. FIG. 1 is a schematic diagram showing the concept of an electroplating equipment and a workpiece according to the invention. The electroplating equipment 100 is capable of gold-plating on the a through hole of the workpiece 50. The electroplating equipment 100 includes a first mold 10 and a second mold 20. The first mold 10 is electrically coupled to an electroplating positive electrode 1 and the second mold 20 is electrically coupled to an electroplating negative electrode 2. The workpiece 50 having the through hole 52 is held between the first mold 10 and the second mold 20 during the electroplating process and an electroplating fluid 3 will be poured into the through hole 52 so as to electroplating the wall of the through hole 52. It should be noted that the electroplating fluid 3 may be, but not limited to, gold fluid or nickel fluid.

Figure 2:
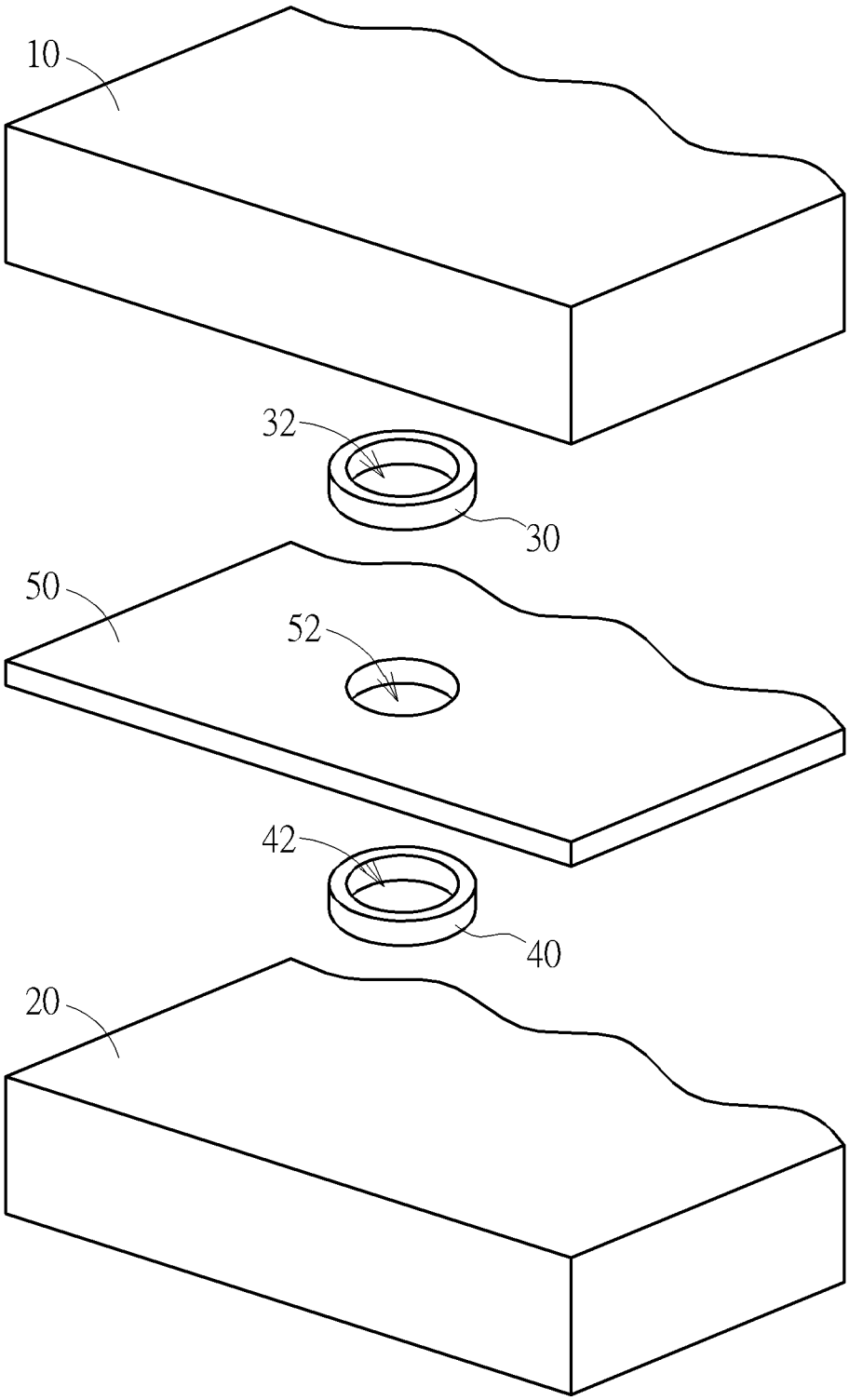
FIG. 2 is a schematic diagram showing partial view of a first ring and a second ring.
Figure 3:
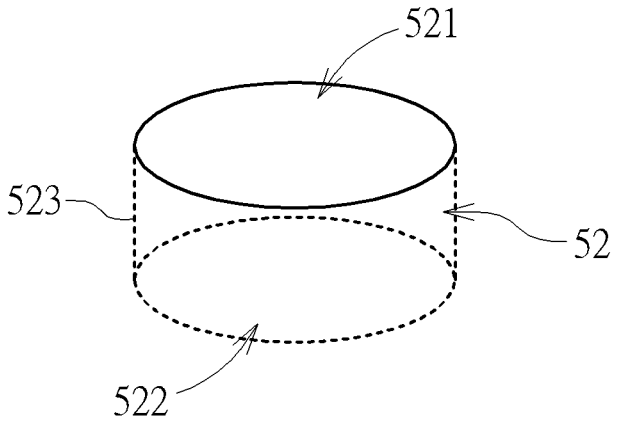
FIG. 3 is a schematic diagram of partial view of the through hole of the workpiece.

Please refer to FIG. 2 and FIG. 3. FIG. 2 is a schematic diagram showing partial view of a first ring and a second ring and FIG. 3 is a schematic diagram of partial view of the through hole of the workpiece. The electroplating equipment 100 further includes a first ring 30 and a second ring 40. The first ring 30 is disposed between the first mold 10 and the workpiece 50 and the second ring 40 is disposed between the second mold 20 and the workpiece 50. The through hole 52 of the workpiece 50 will be the main part that is electroplated. As shown in FIG. 3, the through hole 52 has a first opening 521 and a second opening 522 at opposite sides and a wall 523 of the through hole 52 is formed between the first opening 521 and the second opening 522. More specifically, the wall 523 of the through hole 52 is the place to be electroplated. From FIG. 2 and FIG. 3, the first mold 10 is disposed at one side of the workpiece 50 facing the first opening 521 and the second mold 20 is disposed at the other side of the workpiece 50 facing the second opening 522.

Figure 4:
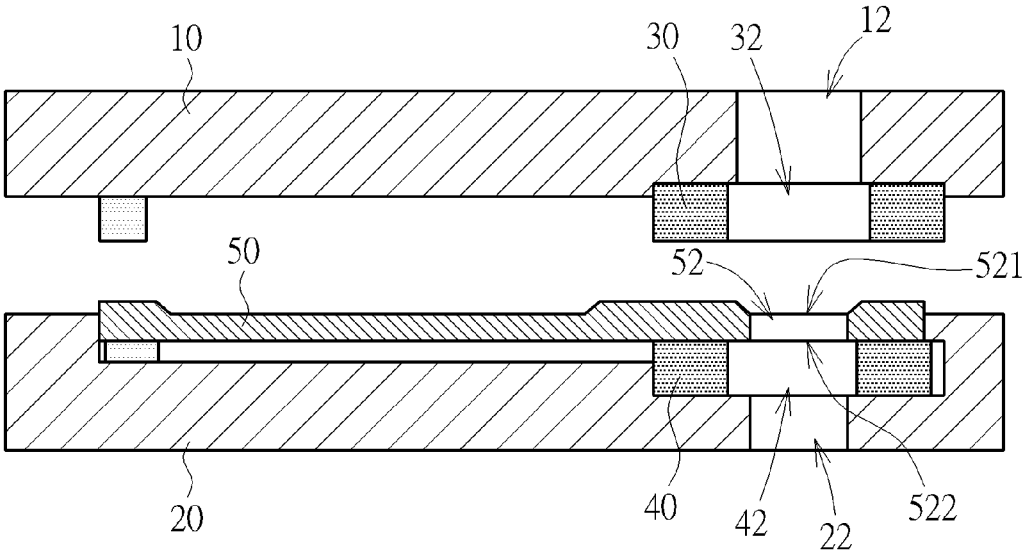
FIG. 4 is a schematic diagram showing a side cross-sectional view of the electroplating equipment of the invention and the workpiece, which has yet been held in the electroplating equipment.

Please refer to fig.4 and also referring to FIG. 2 and FIG. 3 together. FIG. 4 is a schematic diagram showing a side cross-sectional view of the electroplating equipment of the invention and the workpiece, which has yet been held in the electroplating equipment. For the electroplating equipment 100 according to the invention, in order to proceed the electroplating procedure on the wall 523 of the through hole 52 of the workpiece 50 and in the mean time preventing the electroplating fluid 3 from leaking to other non-functional area of the workpiece 50, the configuration of the first ring 30 and the second ring 40 effectively provides a well sealed channel for the passage of electroplating fluid 3. Specific structure of such is described as followed. The first ring 30 is a deformable hollow ring object having a first hollow hole 32, which has substantially the same contour as the first opening 521 and is slightly larger than the first opening 521. The second ring 40 is also a deformable hollow ring object having a second hollow hole 42, which has substantially the same contour as the second opening 522 and is slightly larger than the second opening 522. As it is possible for each workpiece 50 coming with a through hole 52 to be electroplated that has the first opening 521 and the second opening 522 with any shape of contour, and furthermore, the contour of the first opening 521 may be different from that of the second opening 522, the first ring 30 and the second ring 40 may be chose, practically, to have the first hollow hole 32 and the second hollow hole 42 that respectively match the first opening 521 and the second opening 522 of the through hole 52 of the workpiece 50. Although the illustrations of the embodiment have shown the first hollow hole 32 and the second hollow hole 42 in the shape of circular or oval, the shape of the hollow holes is not limited to what is illustrated. Additionally, the first ring 30 and the second ring 40 are made of, but not limited to, silicone.

Referring to FIG. 4, the first mold 10 includes an injection channel 12, which aligns with the first opening 521 of the workpiece 50 when the workpiece 50 is disposed between the first mold 10 and the second mold 20. The first ring 30 is disposed between the injection channel 12 and the first opening 521 and the first hollow hole 32 also has alignment with the injection channel 12 and the first opening 521. The second mold 20 includes a recycling channel 22, which aligns with the second opening 522 of the workpiece 50 when the workpiece 50 is disposed between the first mold 10 and the second mold 20. The second ring 40 is disposed between the recycling channel 22 and the second opening 522 and the second hollow hole 42 also has alignment with the recycling channel 22 and the second opening 522.

Figure 5:
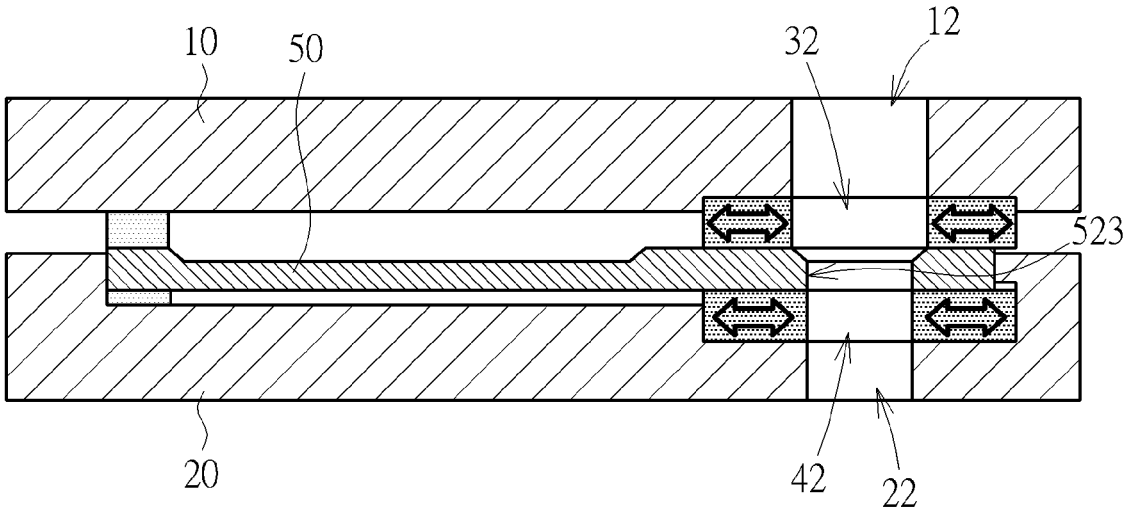
FIG. 5 is a schematic diagram showing a side cross-sectional view of the electroplating equipment of the invention and the workpiece that is held in the electroplating equipment.

Please refer to FIG. 5. FIG. 5 is a schematic diagram showing a side cross-sectional view of the electroplating equipment of the invention and the workpiece that is held in the electroplating equipment. As the workpiece 50 is to be electroplated, the first mold 10 and the second mold 20 approach to each other to hold tight the workpiece 50 by exerting a pressing force on the workpiece 50. The first ring 30 and the second ring 40 disposed between the workpiece 50 and the molds are also pressed to deform, causing the first hollow hole 32 of the first ring 30 and the second hollow hole 42 of the second ring 40 to reduce slightly in size accordingly. The size of the contour of the reduced first hollow hole 32 is no less than that of the first opening 521 and the size of the contour of the reduced second hollow hole 42 is no less than that of the second opening 522, so that the first ring 30 and the second ring 40 cover tightly the first opening 521 and the second opening 522 of the workpiece 50, and the injection channel 12, a hole wall defining the first hollow hole 32 of the first ring 30, a hole wall defining the second hollow hole 42 of the second ring 40, and the recycling channel 22 cooperatively form a seamless flow channel with the wall 523 of the through hole 52 of the workpiece 50.

The electroplating equipment 100 is so holding tight the workpiece 50 that the workpiece 50 is disposed on the second mold 20 in direct contact, thereby also establishing the electroplating negativity on the workpiece 50, while the electroplating fluid 3 as shown in FIG. 1 has electroplating positivity, so as to be conveyed from the injection channel 12, to flow through the first opening 521, and to be electroplated onto the wall 523 when flowing through the wall 523. The electroplating fluid 3 will then be recycled from the recycling channel 22 after flowing through the second opening 522.

It should be noted that the electroplating equipment 100 functions much advantageously on electroplating the wall 523 of the workpiece 50 having through hole 52 with miniature size. In one preferred embodiment, the first mold 10 and the first ring 30 are preferably disposed gravitationally under the workpiece 50, whereas the second mold 20 and the second ring 40 are disposed gravitationally over the workpiece 50, so as to further prevent the electroplating fluid 3 from leaking caused by the gravity and to provide better electroplating outcome.

The electroplating equipment according to the embodiment of the invention disposes the hollow first ring between the first mold and the through hole of the workpiece, and the hollow second ring between the second mold and the through hole of the workpiece, such that the first ring and the second ring provide substantially equivalent channel as the openings of the through hole when the first mold and the second mold are set to hold tight the workpiece. The first ring and the second ring, along with the injection channel of the first mold and the recycling channel of the second mold and the through hole of the workpiece, form a seamless flow channel for the electroplating fluid to flow and be electroplated on the wall of the through hole. The electroplating equipment provided in the application is particularly suitable for electroplating the workpiece with miniature through hole and the process of peeling and recycling electroplating metal on other nonfunctional area is no longer required.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electroplating equipment capable of gold-plating on a through hole of a workpiece, the through hole comprising a first opening and a second opening at opposite sides of the workpiece, a wall of the through hole formed between the first opening and the second opening, the electroplating equipment comprising:

a first mold, electrically coupled to an electroplating positive electrode, the first mold disposed at one side of the workpiece facing the first opening, the first mold comprising an injection channel aligning with the first opening;

a second mold, electrically coupled to an electroplating negative electrode, the second mold disposed at the other side of the workpiece facing the second opening, the second mold comprising a recycling channel aligning with the second opening;

a first ring, comprising a first hollow hole and disposed between the injection channel of the first mold and the first opening; and a second ring, comprising a second hollow hole and disposed between the recycling channel of the second mold and the second opening;

wherein the first mold and the second mold holds tight the workpiece by exerting pressing force on the workpiece and wherein an electroplating fluid from the injection channel flows through the first opening and is electroplated onto the wall when flowing through the wall, and is recycled from the recycling channel after flowing through the second opening.

2. The electroplating equipment of claim 1, wherein when the first mold and the second mold holds tight the workpiece by exerting pressing force on the workpiece, the first ring and the second ring are pressed to deform and the contour of the first hollow hole is no less than the first opening and the contour of the second hollow hole is no less than the second opening.

3. The electroplating equipment of claim 2, wherein the contour of the first hollow hole is substantially the same as and slightly larger than the first opening and the contour of the second hollow hole is substantially the same as and slightly larger than the second opening.

4. The electroplating equipment of claim 1, wherein the first mold and the first ring are disposed gravitationally under the workpiece and the second mold and the second ring are disposed gravitationally over the workpiece.

5. The electroplating equipment of claim 1, wherein the injection channel, a hole wall defining the first hollow hole of the first ring, a hole wall defining the second hollow hole of the second ring, and the recycling channel cooperatively form a seamless flow channel with the wall of the through hole.

6. The electroplating equipment of claim 1, wherein the first ring and the second ring are made of silicone.

* * * * *